United States Patent [19]

Morris

[11] 4,089,006

[45] May 9, 1978

[54] MAST-SUPPORTED ANTENNA MOUNTING BLOCK

[75] Inventor: Lowell H. Morris, Dixon, Calif.

[73] Assignee: Morris Manufacturing Company, Dixon, Calif.

[21] Appl. No.: 713,601

[22] Filed: Aug. 11, 1976

[51] Int. Cl.[2] ..... H01Q 1/12

[52] U.S. Cl. ..... 343/890

[58] Field of Search ..... 343/805, 809, 810, 878, 343/880, 888, 890

[56] References Cited

U.S. PATENT DOCUMENTS

| | | | |
|---|---|---|---|
| 2,299,218 | 10/1942 | Fener | 343/810 |
| 2,481,801 | 9/1949 | Valach | 343/880 |
| 2,979,720 | 4/1961 | Leonard | 343/878 |
| 3,228,031 | 1/1966 | Kitamura et al. | 343/805 |

FOREIGN PATENT DOCUMENTS

| | | | |
|---|---|---|---|
| 149,745 | 4/1950 | Australia | 343/809 |

*Primary Examiner*—Eli Lieberman
*Attorney, Agent, or Firm*—Roger B. Webster

[57] ABSTRACT

A substantially hollow block—formed of initially separate halves secured together as a rigid unit—engaged on the upper end of a tubular mast, with bolts in the block projecting from opposite sides thereof, and the bolts mounting the opposed arms of an antenna on the block; the antenna lead extending into the block from within the mast, and the lead wires being attached in the block to said bolts. Improved instrumentalities are associated with the block and separately function to prevent rotation of the block relative to the mast whereby directional orientation of the antenna is maintained; to preclude twisting, as well as longitudinal movement, of the antenna lead in the block so that the antenna wires cannot be accidentally detached from the bolts; and to prevent rotation of the bolts in the block and hence avoid otherwise resultant breaking-off of said attached antenna wires.

2 Claims, 6 Drawing Figures

MAST-SUPPORTED ANTENNA MOUNTING BLOCK

BACKGROUND OF THE INVENTION

1. Field of the Invention

Antenna units—for television or radio reception—as heretofore available for use on recreational vehicles, or in comparable adaptations have heretofore, in certain types, comprised a tubular mast, opposed antenna arms, and a block engaged on the upper end of the mast, with the antenna arms bolted to such block; the antenna lead usually extending upwardly in the mast, with the lead wires connected to bolts in the block. The present invention was conceived in a successful effort to provide an improved mounting block for the purpose described.

2. The Prior Art

While the prior art includes antenna-mounting devices in sundry embodiments, applicant has no knowledge of any prior art disclosing the particular structure of the herein-claimed antenna mounting block.

SUMMARY OF THE INVENTION

The present invention provides, as a major object, a mast-supported antenna mounting block which is preferably of molded plastic and formed as initially separate halves subsequently adhesively secured together as a rigid unit; the block, which is substantially hollow, including a downwardly opening bore for reception of the upper end of a tubular mast, and bolts which extend from within the block and project from opposite sides thereof for attachment of corresponding antenna arms; the antenna lead extending into the block from within the mast, and the lead wires being attached in the block to said bolts. Improved instrumentalities are associated with the block and separately function to prevent rotation of the block relative to the mast whereby directional orientation of the antenna is maintained; to preclude twisting, as well as longitudinal movement, of the antenna lead in the block so that the antenna wires cannot be accidentally detached from the bolts; and to prevent rotation of the bolts in the block and hence avoid otherwise resultant breaking-off of said attached antenna wires.

The present invention provides, as another important object, a mast-supported antenna block, as in the preceding paragraph, wherein a boss projects from the block through a hole in the mast to prevent rotation of the block relative to the mast; a tongue projects from the block through a slot in the antenna lead to preclude twisting as well as longitudinal movement of said lead relative to the block; and non-circular heads on the bolts are received in matching cavities in the block to prevent rotation of the bolts in said block.

The present invention provides, as a further object, an improved, initially two-part antenna mounting block—preferably of molded plastic—designed for mass production and ready assembly with the other parts of an antenna unit.

The present invention provides, as a still further object, a practical, reliable, and durable antenna mounting block, and one which is exceedingly effective for the purpose for which it is designed.

DESCRIPTION OF THE PREFERRED EMBODIMENT

Figure 1:
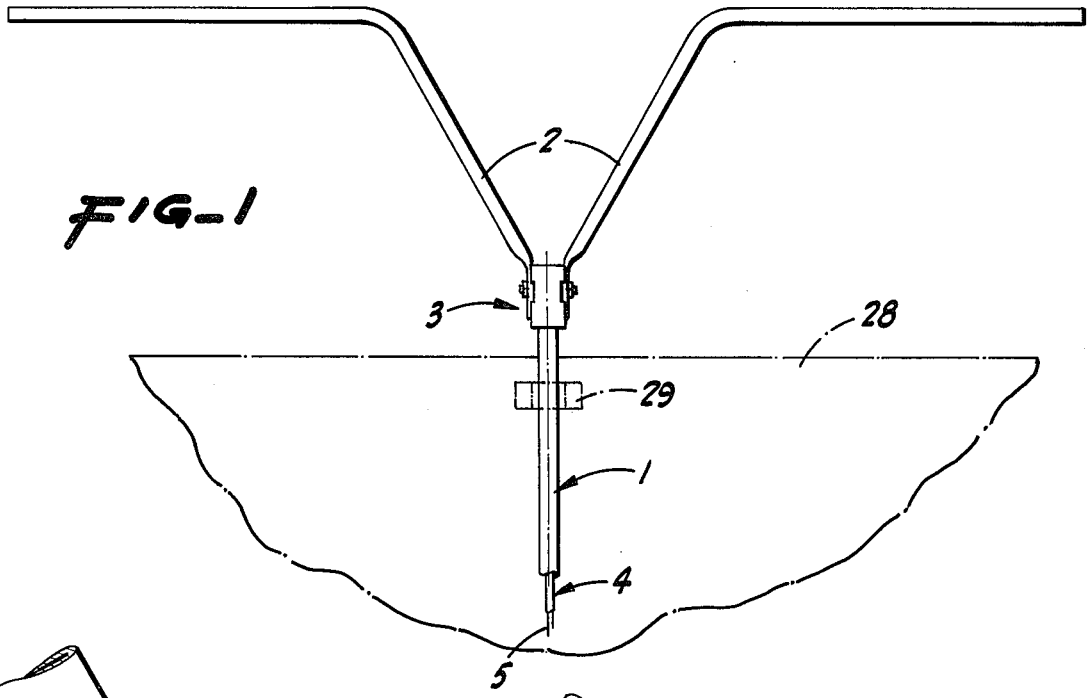
FIG. 1 is a front elevation showing an antenna unit, including my improved, initially two-part, antenna mounting block, installed with the opposed antenna arms in a vertical plane.

Referring now more particularly to the drawings and to the characters of reference marked thereon, the present invention represents improvements in a mast-supported antenna mounting block which is employed in an antenna unit comprised of a tubular mast 1, opposed antenna arms 2, and a block—indicated generally at 3—engaged on the upper end of the mast; the antenna lead 4 extending upwardly in the mast 1, with the lead wires 5 extending into the block 3 and therein being connected to the inner ends of bolts 6 which extend out of the block and project from opposite sides thereof. The antenna arms 2 have flat ears 7 on their inner ends and through which ears the bolts 6 pass; there being nuts 8 on the bolts securing the ears 7, and hence the antenna arms 2, to the block 3.

The block 3, which is vertically elongated, embodies the present invention and comprises—preferably of plastic—a pair of complementary half-blocks 9 and 10 which are initially separate but are matingly engaged, and adhesively bonded together, at the time of assembly of said block 3 on the mast 1. The mating marginal edges are indicated at 11, and proper register is assured by a locator pin 12 on the block-half 9, and which pin is received in a socket 13 in the block-half 10.

The block 3—as formed by the bonded-together block-halves 9 and 10—is substantially hollow and includes, in the lower portion, a downwardly opening cylindrical bore 14 in which the upper end of the mast 1 is engaged. The mast is held in such bore against both longitudinal and rotational movement relative to the block 3 by a boss 15 integral with the block-half 9 and projecting from the bore 14 radially inwardly through a hole 16 in the adjacent wall of the mast.

The top of the mast 1 occupies a position in the bore 14 in a plane adjacent but short of a horizontal cross wall 17 formed in each half of the block 3, and a radial stud 18 is integral with the block-half 9 above boss 15 and projects in overhanging relation to said top of the mast; the radially inner end portion of such stud 18, and which is substantially centered over the mast, being formed as a short, flat tongue 19 disposed edgewise vertically.

The antenna lead 4 extends, as usual, upwardly in the mast 1, and the wires 5 of such lead are spaced apart by an integral center web 20. In the immediate zone of the tongue 19, the center web of the lead 4 is formed with a slot 21 in which said tongue 19 is received; such tongue thus preventing twisting as well as longitudinal movement of the upper end portion of lead 4 in the block 3.

A central vertical wall 22, in each half of the block 3, reinforces the related horizontal cross wall 17; the two such cross walls having pairs of closely spaced notches 23 in the mating edges thereof whereby the laterally spaced wires 5 of the upper part of the lead 4 are, in effect, clamped in said notches 23 when the block-halves 9 and 10 are bonded together with the cross walls in edge engagement. This further assures against undesired accidental motion of the upper portion of the lead 4 in the block 3.

Above the cross wall 17, the wires 5 of lead 4 are bared and attached to necks 24 included, for the purpose, on the inner ends of bolts 6.

The bolts 6 include, intermediate their ends, enlarged square heads 25 which occupy corresponding, matching pockets 26 in the sidewalls of the block 3; such pockets each being formed in equal parts in the block-halves 9 and 10. With the heads 25 being non-rotational in the pockets 26, the bolts 6 cannot turn in the bolt-receiving bores 27, and—as a consequence—the connected wires 5 are protected against breakage which could otherwise occur.

Figure 2:
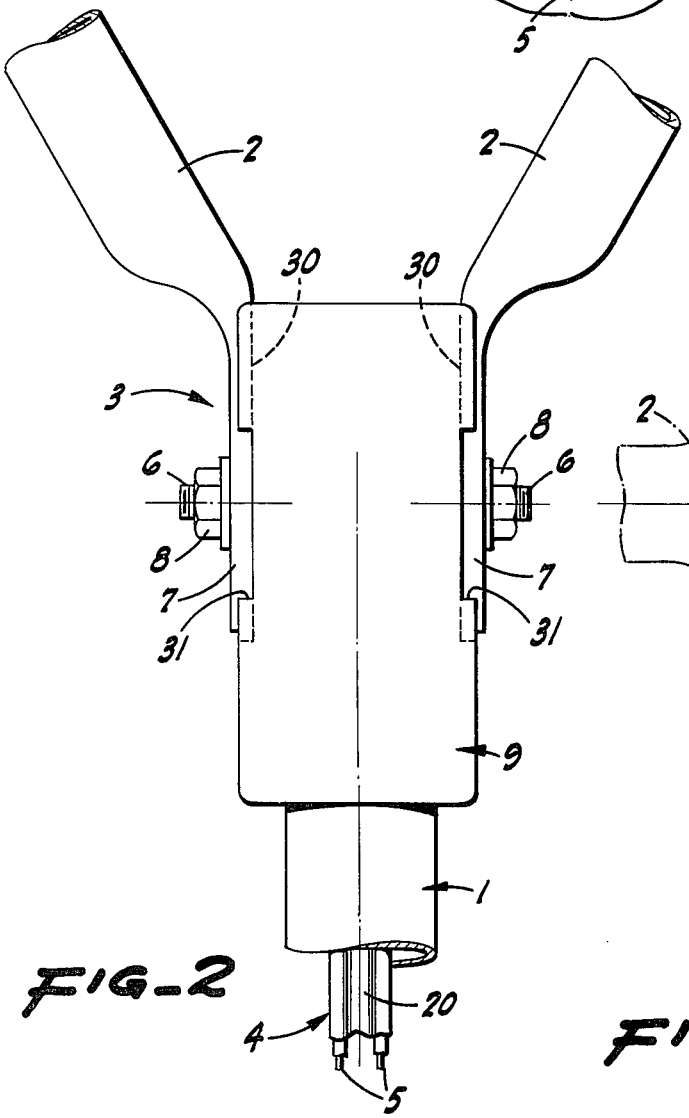
FIG. 2 is an enlarged fragmentary elevation of the antenna unit as shown in FIG. 1.
Figure 3:
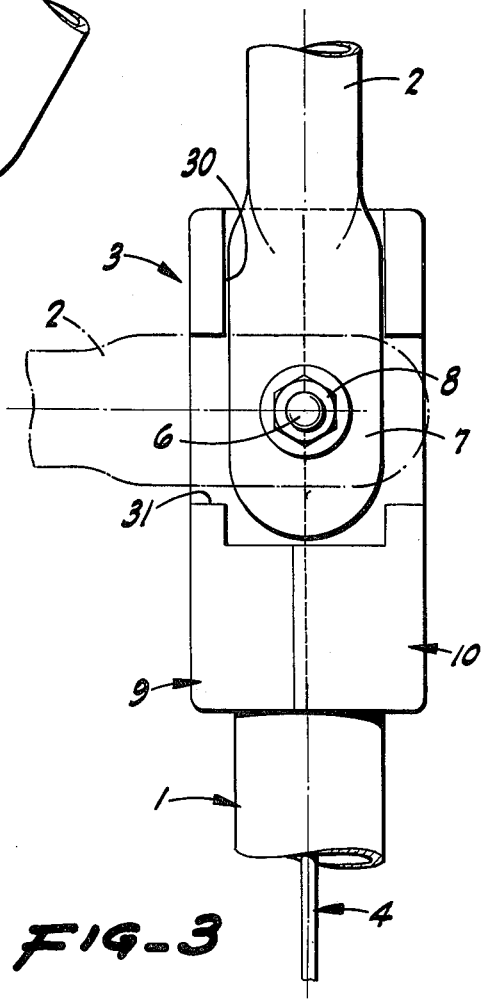
FIG. 3 is an enlarged fragmentary side elevation of the antenna unit as shown in FIG. 1; the opposed antenna arms being illustrated, in broken lines, as mounted in a horizontal plane as an alternative working position.
Figure 4:
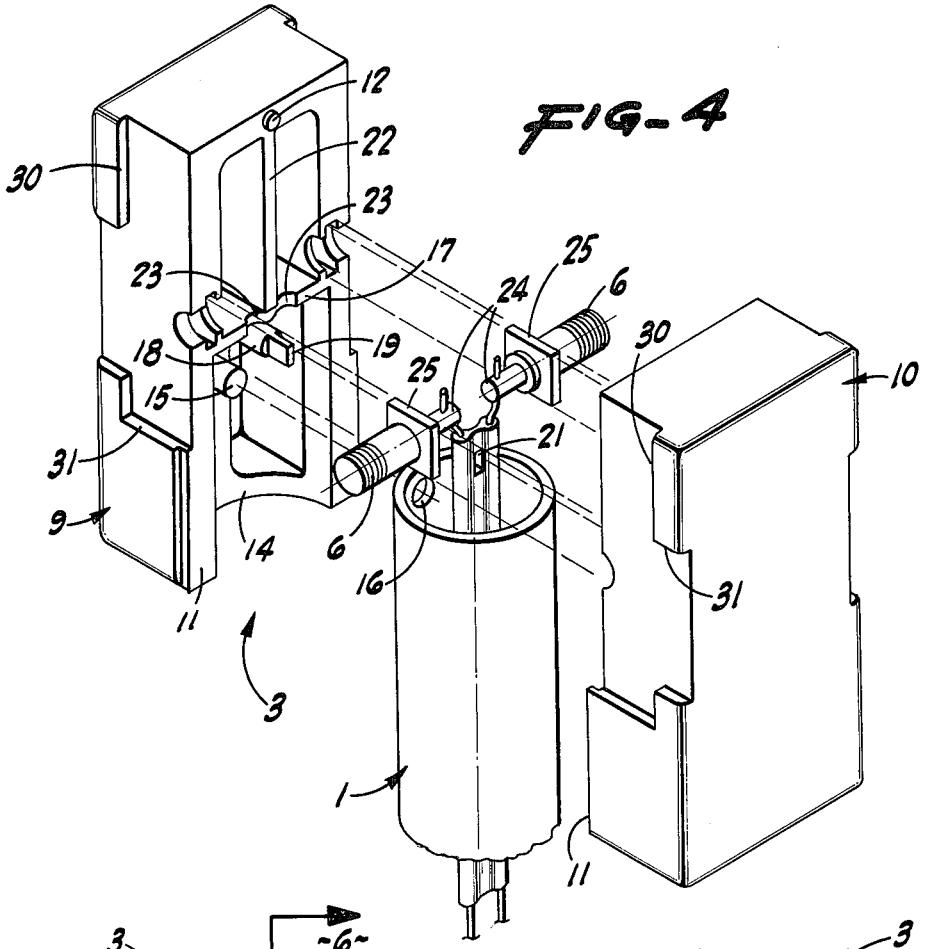
FIG. 4 is an enlarged, exploded view of an antenna unit including my improved, initially two-part, mounting block; the antenna arms being omitted.
Figure 5:
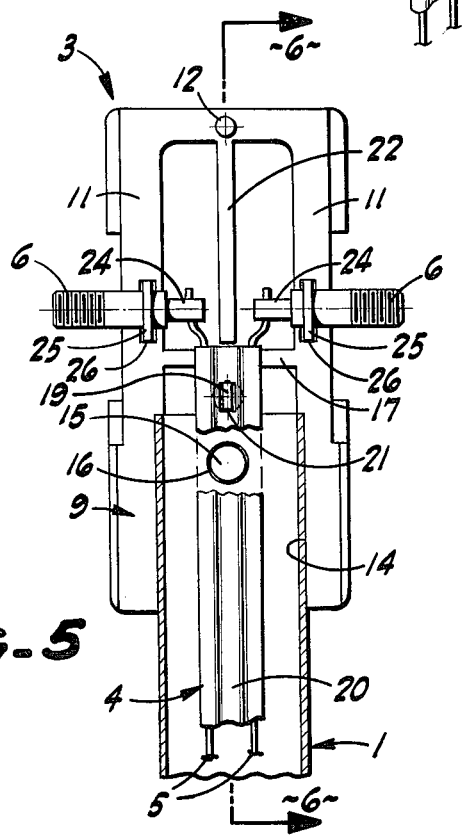
FIG. 5 is an elevation of the same as assembled, but absent the near half of the block; the mast being in section.
Figure 6:
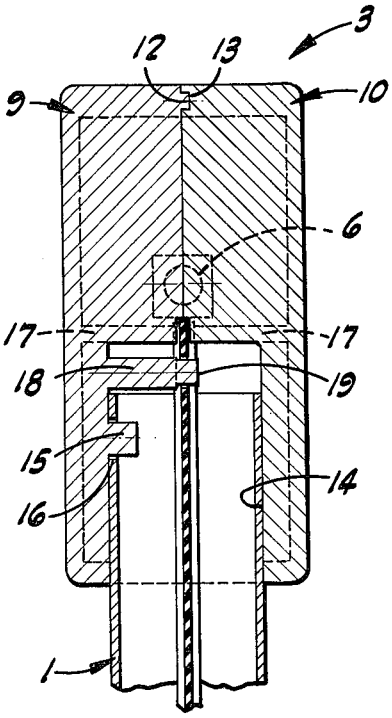
FIG. 6 is a sectional elevation on line 6—6 of FIG. 5, but shows the block in full assembly.

The mast 1 is secured to a recreational vehicle or the like, and as shown in part at 28, by clamps—one of which is shown at 29. As shown in FIGS. 1 and 2, the antenna arms 2 can be attached to block 3 to extend upwardly in a vertical plane, or, as shown in FIG. 3, can be attached to said block to extend laterally in a horizontal plane.

To assure against the antenna arms remaining in a vertical plane, or a horizontal plane, as the case may be, and without turning on the bolts 6, the block is vertically and shallow-grooved on the sides, as at 30, to receive and locate the ears 7 when the antenna arms are in said vertical plane, and said block is horizontally and shallow-grooved on the sides, as at 31, to receive and locate such ears 7 when the antenna arms are in said horizontal plane. On each side of block 3, the grooves 30 and 31 do, of course, intersect each other and in such relation that the ears 7 can be received on the bolts 6 when said ears are either vertical or horizontal.

From the foregoing description, it will be readily seen that there has been produced such an antenna mounting block as substantially fulfills the objects of the invention as set forth herein.

While this specification sets forth in detail the present and preferred construction of the antenna mounting block, still in practice such deviations from such detail may be resorted to as do not form a departure from the spirit of the invention as defined by the appended claims.

I claim:

1. An improved block for an antenna unit which includes a tubular mast, a block engaged on the upper end of the mast, the block having a downwardly opening bore in which the upper end of the mast is received, antenna elements, bolts securing the antenna elements to the block, and an antenna lead extending upwardly in the mast and into the block, with the lead wires connected in the block to the bolts; characterized by said improved antenna mounting block comprising, in combination, initially separate but mating halves, said block-halves being rigidly secured together upon inclusion of such block in the antenna unit by engagement on the mast, means between the block and the antenna lead preventing relative motion therebetween, and means between the block and the bolts preventing rotation of the latter; said motion-preventing means between the block and lead comprising a tongue formed with the block and projecting inwardly in intersecting relation to the lead, and the latter having a slot therein through which the tongue projects.

2. An antenna mounting block, as in claim 1, in which the initially separate halves of the block have members therein which substantially mate, with the lead engaged therebetween, when said block-halves are rigidly secured together; the point of such engagement with the lead being adjacent but above the tongue.

* * * * *